United States Patent [19]

Kanki et al.

[11] 4,114,819

[45] Sep. 19, 1978

[54] APPARATUS FOR SUPPORTING A BOBBIN HOLDER SHAFT IN A HIGH SPEED WINDER

[75] Inventors: Hiroshi Kanki, Kakogawa; Kazuyoshi Yasuda; Hisashi Tatsuke, both of Nagoya, all of Japan

[73] Assignee: Mitsubishi Jukogyo Kabushiki Kaisha, Tokyo, Japan

[21] Appl. No.: 723,052

[22] Filed: Sep. 13, 1976

[30] Foreign Application Priority Data

Sep. 25, 1975 [JP] Japan ..... 50-114918

[51] Int. Cl.[2] ..... B65H 54/44

[52] U.S. Cl. ..... 242/18 R

[58] Field of Search ..... 242/18 R, 18 G, 18 DD; 57/100, 130, 135

[56] References Cited

U.S. PATENT DOCUMENTS

| | | | |
|---|---|---|---|
| 3,109,602 | 11/1963 | Smith | 242/18 R |
| 3,254,850 | 6/1966 | Martin et al. | 242/18 R |
| 3,973,739 | 8/1976 | Nilgens et al. | 242/18 R |

*Primary Examiner*—George F. Mautz

*Attorney, Agent, or Firm*—Cushman, Darby & Cushman

[57] ABSTRACT

A bobbin holder shaft is journalled in a bobbin holder shaft support that is, in turn elastically supported relative to a fixed frame. When the support weighs more than the shaft plus the full amount of yarn to be wound thereon, and the lowest order resonant speed is below the operating speed, a high operating speed can be achieved without inducing a resonant vibration even though a pronounced band or ribbon appeared on the wound yarn ball. In a preferred embodiment, the elastic support is provided by axially spaced O-rings and an oil-filled reservoir defined axially between them.

2 Claims, 8 Drawing Figures

APPARATUS FOR SUPPORTING A BOBBIN HOLDER SHAFT IN A HIGH SPEED WINDER

BACKGROUND OF THE INVENTION

FIG. 1 shows a principle of a structure for supporting a bobbin holder shaft in the prior art, in which reference numeral 1 designates a bobbin holder which is supported from a frame 5 via a bobbin holder shaft 2 and bearings 3 and 4. The bobbin holder 1 is mounted on the bobbin holder shaft 2 so as to be freely rotatable with said shaft 2 and has a known device (not shown) for holding the bobbin assembled therein, so that a yarn supplied while being traversed in the axial direction of the bobbin holder may be wound up on the bobbin to form a cheese-shaped wound yarn ball 6. In the case of the prior art winders, a supply speed of a yarn was of the order of 1500 – 2000 m/Min. at the fastest and an outer diameter of a bobbin was of the order of 150 – 200 mm, so that a rotational speed of a bobbin holder shaft could be of the order of 4000 rpm in use, and therefore, if a primary critical speed (i.e., lowest order resonant point) was preset at a value higher than 5000 rpm, then there remained no problem in practice. For that purpose it was only necessary to make a bobbin holder shaft thick and to make the bearing portion rigid for enhancing rigidity of the rotary shaft system including the bobbin holder. Recently, however, since a supply speed of a yarn of 3000 – 4000 m/Min., an outer diameter of a bobbin of 85 – 110 mm and a longer bobbin holder length have come to be required as an influence of innovation in technology, rationalization and campaign for enhancement of productivity, it has become very difficult to raise the primary critical speed of a bobbin holder shaft to keep it higher than the operating speed. In addition, the operating rotational speed now is as high as 10,000 – 15,000 rpm, so that it is impossible to preset a primary critical speed higher than the operating rotational speed as is the case of the prior art. In such cases, it has been considered effective to pliably support the bearings for the bobbin holder shaft to lower the primary critical speed of the bobbin holder shaft outside the range of and under the operating rotational speed region.

FIG. 2 shows the principle of a structure for pliably supporting bearings for a bobbin holder shaft as described above, in which reference numeral 7 designates a bobbin holder which is mounted on a bobbin holder shaft 8 so as to be freely rotatable with said bobbin holder shaft, which has a known device (not shown) for holding a bobbin assembled therein, and which is constructed so as to form a wound yarn ball 9 on the bobbin. The bobbin holder shaft 8 is supported by bearings 10 and 11, O-rings 13 and 14 made of rubber being pinched between the outer circumferences of said bearings 10 and 11 and a frame 12, and since the bobbin holder shaft 8 is supported elastically via the O-rings 13 and 14, the primary critical speed is lowered. However, in order to lower the primary critical speed under the operating rotational speed range according to this method, the elasticity of the O-rings 13 and 14 must be lowered to such degree that there may occur a practical problem. If this is practiced, because of the small elasticity of the O-rings, not only the bobbin holder 7 has its tip end cantilevered downwards by its own weight, but also the amount of downward drooping of the tip end will be increased gradually as the wound yarn ball 9 is formed, and thereby the shape and quality of the wound yarn ball 9 is adversely affected. Furthermore, because of the fact that the elasticity of the O-rings is extremely small, there is a disadvantage that the bobbin holder shaft will swing largely due to transient vibration generated upon passing through a lower order of critical speed, resulting in abnormal vibration exceeding the gap space $c$ provided between the bearing 10 and the frame 12.

In addition, in the case of the transient vibration either upon passing through the lower order of critical speed or upon generation of a ribbon or a band on a wound yarn ball (See FIGS. 4 and 5), the self-damping effect of rubber caused by deformation of the O-ring is not sufficient as an attenuation effect that is effective for suppressing the amplitude of the transient vibration, so that it is impossible to maintain the shape and quality of the wound yarn ball good. Ribbons and bands are caused when the relation between a rotational speed A of the bobbin holder and a reciprocating frequency B of a traverse guide (not shown) satisfies $A/B = N$ (where N is an integer). For instance, assuming that $A = 500$ rpm and $B = 250$ reciprocal cycles/Min., then we obtain $A/B = 2$, and for $A = 2$ rpm, $B = 1$ reciprocal cycle/Min is valid, which means that a yarn will trace the same route on a bobbin holder. A protrusion produced on a wound yarn ball from the above-mentioned reasons is called a ribbon 15. On the other hand, a band 16 is a protrusion generated in the neighborhood of $A/B = N$, where though a ribbon 15 is somewhat dispersed, the dispersion is not sufficient and a broad protrusion is produced.

FIG. 3 shows an equivalent vibration model for the apparatus shown in FIG. 2. In FIG. 3, $k_1$, $k_2$ and $c$, respectively, represent the elasticity and attenuation constant of the O-rings used at the bearing portions, $w$ represents a weight of the bobbin holder, bobbin holder shaft and bearings, and W represents a weight of a wound yarn ball. Assuming now that a yarn is just before being wound on a bobbin, then $W = 0$ is valid, and the vibration model represents the state where a rod having a weight $w$ is supported by two springs having elastic constants $k_1$ and $k_2$, respectively. The characteristic frequency at this moment of the vibration model has two values for lower order vibration modes where the rod is not bent, which correspond to a primary critical speed and a secondary critical speed, respectively, and therefore, it is only necessary to select the values of $w$, $k_1$ and $k_2$ so that said either critical speed falls outside of the operating rotational speed region of the winder. However, in the recent high speed type winders, the value of $w$ is small because of the required specification and technical requirements, and so, unless the values of $k_1$ and $k_2$ are also reduced to a small value, the lower order of critical speed cannot be suppressed to a low value. Accordingly, even in case that only $w$ exists, the springs are deformed and the rod not only sinks down but also tilts with its front end lowered, and further, as a yarn is successively wound and laminated and as a weight W is added, the tilting with the front end lowered becomes more remarkable, and the shape and quality of the wound yarn ball are also very adversely affected. In addition, in the case of the equivalent vibration model shown in FIG. 3, the damping effect is caused by the deformation of the O-rings and is thus small, and even if the primary and secondary critical speeds are preset outside of the operating rotational speed range so as not to generate resonance, attenuation of unstable vibration caused by transient vibration is weak, so that there are disadvantages such that deformation is given to a wound yarn ball, unbalanced excitation of vibration and displaced excitation of vibration are generated, and the quality of the yarn in the wound ball is deteriorated.

SUMMARY OF THE INVENTION

The inventors of the present invention have considered the trend of the industrial field and generally investigated technical possibility, maneuverability, economy, etc., and as a result, have reached a conclusion that it is not advantageous to raise the primary and secondary critical speeds above the operating rotational speed region. Therefore, on the contrary, the inventors provide a bobbin rotational speed exceeding the primary and secondary critical speeds, and have found a way of pliably supporting a bearing portion. Also the present invention has been devised for the purpose of attaining a stability against successive increase of a shaft weight, reduction of a rotational speed, an unbalanced weight of a wound yarn ball, variation of a position, and transient vibration due to ribbon and band winding, which are caused by laminated winding of a yarn that is an inherent function of a winder.

A bobbin holder shaft is journalled in a bobbin holder shaft support that is, in turn elastically supported relative to a fixed frame. When the support weighs more than the shaft plus the full amount of yarn to be wound thereon, and the lowest order resonant speed is below the operating speed, a high operating speed can be achieved without inducing a resonant vibration even though a pronounced band or ribbon appeared on the wound yarn ball. In a preferred embodiment, the elastic support is provided by axially spaced O-rings and an oil-filled reservoir defined axially between them.

The principles of the invention will be further discussed with reference to the drawings wherein a preferred embodiment is shown. The specifics illustrated in the drawings are intended to exemplify, rather than limit, aspects of the invention as defined in the claims.

DETAILED DESCRIPTION OF THE PRESENTLY PREFERRED EMBODIMENT

Figure 6:
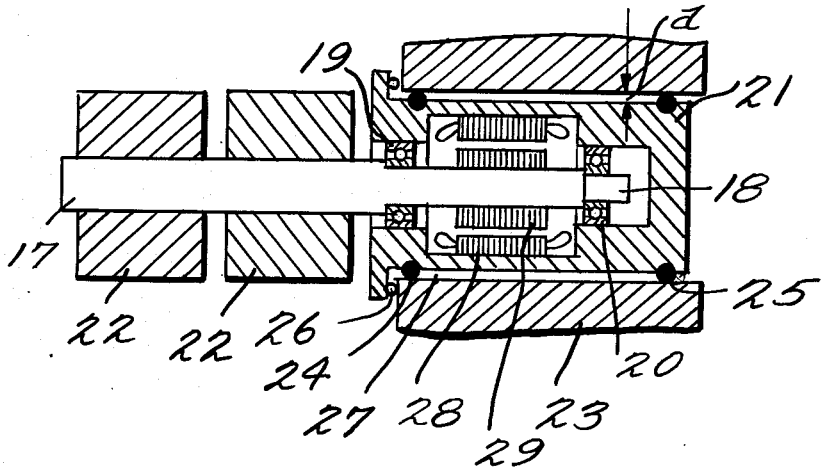
FIG. 6 is a longitudinal sectional view of a winder provided in accordance with principles of the present invention.

Now description will be made on a preferred embodiment illustrated in FIGS. 6 and 7 of the accompanying drawings. FIG. 6 is a longitudinal cross-sectional view of an apparatus for supporting a bobbin holder shaft in a high speed winder according to one preferred embodiment of the present invention. In this figure, reference numeral 17 designates a bobbin holder in which a known device (not shown) for holding a bobbin is assembled, and the bobbin holder 17 is supported by a bobbin holder shaft support 21 via a bobbin holder shaft 18 and a pair of bearings 19 and 20. The bobbin holder 17 is mounted on the bobbin holder shaft 18 so as to be freely rotatable with said shaft, and it is constructed in such manner that a yarn (not shown) supplied as being traversed in the axial direction of the bobbin holder 17 may be wound on the bobbin to form a cheese-shaped wound yarn ball 22. The bobbin holder shaft support 21 is inserted in a frame 23 with a small gap clearance *a* retained therebetween and is held in position by means of O-rings 24, 25 and 26. In a space sealingly delimited by the O-rings 24 and 25, the frame 23 and the bobbin holder shaft support 21, is sealed viscous oil 27. In addition, in FIG. 6, reference numerals 28 and 29 designate a stator and a rotor, respectively, of an electric motor, but these members could be replaced by an electric brake or other necessary devices.

Explaining now the preferred operation of the above-described apparatus, the bobbin holder 17 takes up a yarn as supplied while it is rotating at a high speed and thereby forms a cheese-shaped wound yarn ball 22. Thereupon the bobbin holder 17 will vibrate due to an unbalanced weight inherently possessed by the bobbin holder system including the bobbin holder shaft 18 and the rotor 29 mounted on said shaft, and an unbalanced weight existing in the wound yarn ball. In addition, since the supplied yarn has a constant speed regardless of the diameter of the wound yarn ball, it is necessary that the bobbin holder is rotated at a rotational speed inversely proportional to the diameter of the wound yarn ball. As one example of such a driving system, a driving roll system is known in which the wound yarn ball is rotated at a constant circumferential speed (substantially equal to the supply speed of the yarn) while a driving roll is pressed against the circumferential surface of the wound yarn ball. However, since the driving roll (not shown) in this system is rotating jointly with the wound yarn ball effectively pressed against the latter, if there exists a deformation of the circumference of the roll, or an eccentricity or surface unevenness of the wound yarn ball, then a vibrational external force is exerted upon the bobbin holder 17, and thereby vibration will occur. Especially, in case that the ratio of the rotational speed of the bobbin holder 17 to the traverse frequency of the supplied yarn is equal to an integer, then there occurs a phenomenon (ribbon winding) in which the yarn that is wound is concentrated upon a particular portion of a surface of a wound yarn ball, which often degrades roundness of a wound yarn ball and results in vibration. However, while these vibrational forces of the bobbin holder 17 are transmitted to the bobbin holder shaft support 21 via the bobbin holder shaft 18 and the bearings 19 and 20, not only the amplitude of vibration becomes small because of the fact that the weight of the shaft support 21 is larger than that of the bobbin holder 17 and the wound yarn ball 22, but also the vibrational energy is converted into heat and is dissipated owing to the fluid resistance of the viscous oil 27 sealed within the gap clearance *a*. In addition, the O-rings 24, 25 and 26 jointly support the bobbin holder shaft support 21 in an elastic manner, and they serve to shift the lower order of resonance point (critical speed) that is determined by the relation between the mass and the elasticity of the wound yarn ball 22, bobbin holder 17, bobbin holder shaft 18, bearings 19 and 20 and bobbin holder shaft support 21, below the operating rotational speed, and thereby reduce the amplitude of vibration during operational rotation of the bobbin holder 17. To this end, the elasticity, the number and combination of the O-rings 24, 25 and 26 are selected most advantageously. (Although one for each is illustrated in FIG. 6, even if each O-ring consists of a plurality of O-rings, the essence of the present invention is not affected thereby.) In addition, the stator 28 of the motor mounted within the bobbin holder shaft support 21 and the rotor 29 of the motor mounted on the bobbin holder shaft 18 are adapted to receive an electric power controllably supplied from a particular electric power source for enabling winding of a yarn according to a system other than the driving roll system by controllably driving the bobbin holder so as to maintain the circumferential speed of the wound yarn ball always constant, and also the rotor and stator can operate as a braking device for quickly decelerating and stopping the wound yarn ball. However, even if they should be replaced by other necessary devices without departing from the scope of the present invention, the same effects and advantages would be realized.

Figure 1:
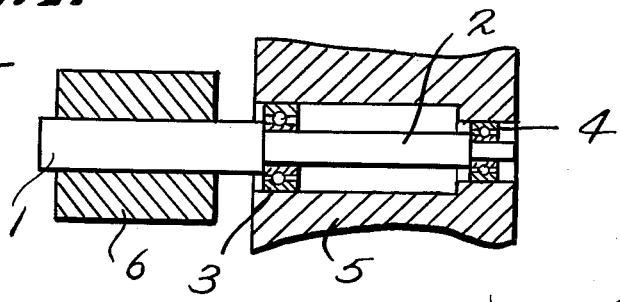
Fig. 1. PRIOR ART
FIG. 1 is a schematic longitudinal sectional view of a prior art non-resiliently journalled winder.
Figure 2:
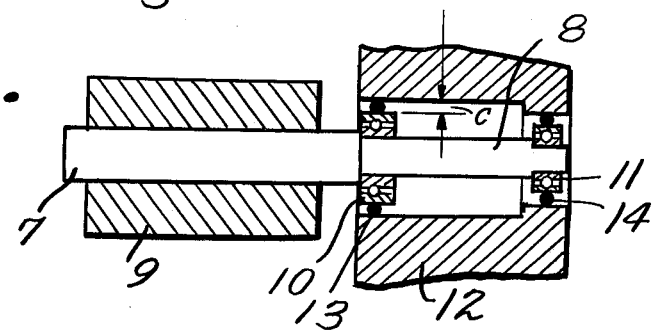
Fig. 2. PRIOR ART
FIG. 2 is a schematic longitudinal sectional view of a prior art resiliently journalled winder.
Figure 3:
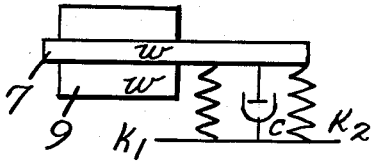
Fig. 3. PRIOR ART
FIG. 3 is a diagram showing an equivalent vibration model of the prior art apparatus of FIG. 2.
Figure 4:
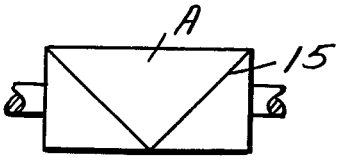
FIG. 4 is a side elevation view of a bobbin with a would yarn ball having a distinct "ribbon"
Figure 5:
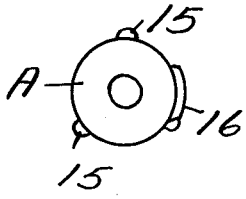
FIG. 5 is an end elevation view of a bobbin with a wound yarn ball having distinct "ribbons" and a distinct "band"
Figure 7:
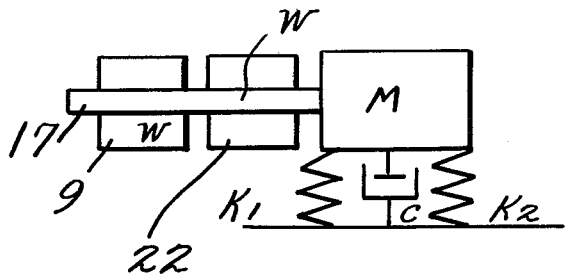
FIG. 7 is a diagram showing an equivalent vibration model of the winder apparatus of FIG. 6.
Figure 8:
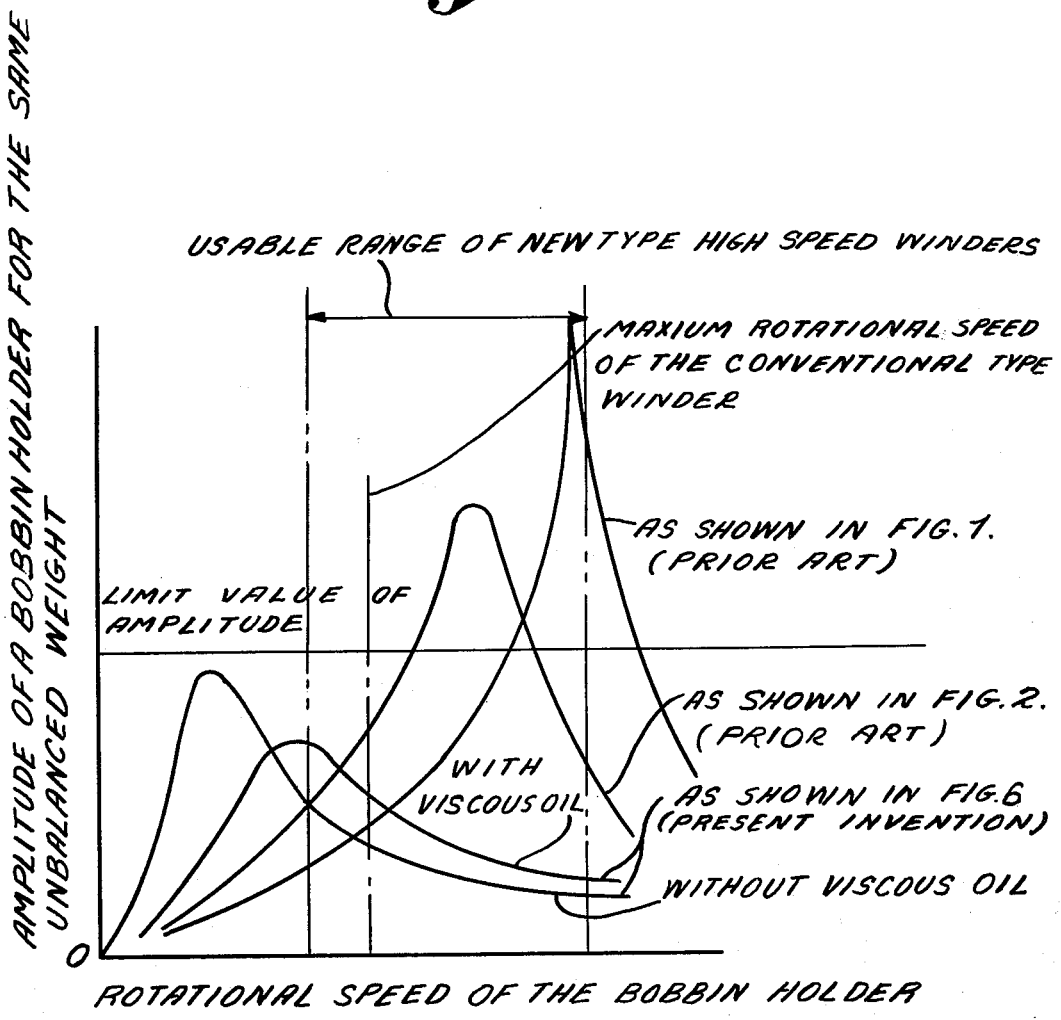
FIG. 8 is a diagram comparing the relations between an amplitude of a bobbin holder for the same unbalanced weight and rotational speeds of the bobbin holder with respect to the apparatus according to the present invention and the prior apparatuses, respectively.

FIG. 7 shows an equivalent vibration model of the apparatus shown in FIG. 6, in which W represents a weight of a wound yarn ball, *w* represents a weight of a bobbin holder, and M represents a weight of a bobbin holder shaft support including a bobbin holder shaft, bearings, a motor, etc., which is selected larger than W + *w*. K1 and K2 represent elasticities of the O-rings which are selected larger than the values of $k_1$ and $k_2$ in the equivalent vibration model of the prior art apparatus as shown in FIG. 3. With regard to the lower order of characteristic frequencies of the equivalent vibration model in FIG. 7, there are two such characteristic frequencies similarly to the apparatuses in the prior art, but the characteristic frequencies become low even though K1 and K2 are large, since the weight M is large, and not only because the characteristic frequencies are under the operating rotational speed range, but also because even if the weight W of the wound yarn ball is varied resulting in increase of an unbalanced weight the influence thereof is small, the amplitude of vibration can be suppressed to a low value. In addition, because the influence of the increase of W upon M is small and also because the elasticities K1 and K2 are relatively large, the amount of lowering of the front end of the rod *w* is suppressed to a very small value, and so, the shape of the wound yarn ball and the quality of the yarn are not adversely affected. Furthermore, C represents an damping coefficient of the viscous oil sealed within the gap clearance *a*, which can effectively suppress transient vibration caused by deformation of a wound yarn ball, ribbon winding, passing through a lower order of critical speed, etc., and which is very effective in that it does not cause the problems of deformation, change in quality, etc. of a wound yarn ball. Illustration of this effect in terms of amplitudes at the tip end of the bobbin holder is the diagram in FIG. 8, which shows that the effect of the present invention is far more excellent than that of the prior art apparatus.

As described in detail above, according to the present invention, the weight of the support for the bobbin holder shaft is selected larger than the weight of the shaft and the weight of the wound yarn ball, and the bobbin holder shaft support is pliably supported, so that even if the elastic constant of the supporting springs should be selected relatively large, the primary and secondary critical speeds could be lowered, and in addition, the lowering of the bobbin holder shaft caused by the weight of the shaft and the weight of the wound yarn ball could be made very small. Furthermore, if viscous oil is sealed within the narrow gap clearance delimited by the frame, the support and the O-rings, then the attenuation effect for the vibration of the support can be realized effectively. Also, the bobbin holder shaft support according to the present invention can be extracted from a casing while being assembled integrally with the bobbin holder shaft, so that dismounting and mounting of the apparatus can be achieved easily. Still further, dynamic balance of a bobbin holder shaft to be rotated at a high speed can be easily adjusted by making use of the bobbin holder shaft support, and therefore, productivity can be enhanced. It is to be noted that the present invention is applicable to every system (spindle drive system, surface drive system, centrifugal system, etc.) of high speed winders, high speed centrifugal separators, high speed spin testers, etc.

It should now be apparent that the method and apparatus for supporting a bobbin holder shaft in a high speed winder as described hereinabove, possesses each of the attributes set forth in the specification under the heading "Summary of the Invention" hereinbefore. Because the method and apparatus for supporting a bobbin holder shaft in a high speed winder can be modified to some extent without departing from the principles of the invention as they have been outlined and explained in this specification, the present invention should be understood as encompassing all such modifications as are within the spirit and scope of the following claims.

What is claimed is:

1. For a bobbin holder having a bobbin holder shaft extending axially at one end thereof, apparatus for supporting the bobbin holder with respect to a stationary frame during high speed winding to provide a wound yarn ball on a bobbin on said bobbin holder, said supporting apparatus comprising:

a bobbin holder shaft support interposed between the bobbin holder shaft and the frame, and including bearing means for journalling the bobbin holder shaft, when supported thereby, for rotation about the longitudinal axis of the bobbin holder;

the elastic bushing means for engaging between the bobbin holder support and the frame, so that as a yarn ball is being wound on a bobbin on the bobbin holder, the yarn ball, bobbin, bobbin holder and bobbin holder shaft support are elastically movable relative to the frame;

the sum of the weights of the bobbin holder shaft support, bobbin holder shaft, bearing means and motor being greater than the sum of the weights of the bobbin holder, wound yarn ball and bobbin;

means for rotating the bobbin holder, bobbin holder shaft, bobbin and yarn ball being wound, about the longitudinal axis thereof for winding a yarn ball at an operating rotational speed, and said bobbin holder and bobbin holder shaft, including the bobbin and yarn being wound thereon, having a primary and secondary critical rotational speed which is less than said operating rotational speed;

the frame including means defining a socket therein, the bobbin holder shaft support being coaxially received in the socket, and the elastic bushing means comprising a plurality of axially spaced elastomeric O-rings interposed coaxially between the resiliently engaging both the bobbin holder shaft support and the frame in said socket;

the O-rings defining axially between them, and the bobbin holder shaft support and socket defining radially between them, a reservoir;

said reservoir being filled with a viscous oil.

2. The supporting apparatus of claim 1, wherein:

the means for rotating the bobbin holder includes:

an electric motor rotor provided on the bobbin holder shaft; and an electric motor stator provided on the bobbin holder support, radially surrounding said electric motor rotor.

* * * * *